US006513956B1

(12) United States Patent
Schaefer et al.

(10) Patent No.: US 6,513,956 B1
(45) Date of Patent: Feb. 4, 2003

(54) LAMP HOUSING ASSEMBLY

(75) Inventors: Roger A. Schaefer, Columbus, IN (US); Eric A. Roth, Seymour, IN (US)

(73) Assignee: Valeo Sylvania LLC, Seymour, IN (US)

( * ) Notice: Subject to any disclaimer, the term of this patent is extended or adjusted under 35 U.S.C. 154(b) by 0 days.

(21) Appl. No.: 09/408,781

(22) Filed: Sep. 30, 1999

(51) Int. Cl.[7] ..... F21V 17/00

(52) U.S. Cl. ..... 362/362; 362/351; 362/303; 362/305

(58) Field of Search ..... 362/343, 351, 362/303, 305, 307, 310, 311, 344

(56) References Cited

U.S. PATENT DOCUMENTS 4,479,072 A * 10/1984 Gaugel et al. ..... 313/113
5,067,054 A 11/1991 Oshio
5,111,368 A * 5/1992 Suzuki et al. ..... 362/61
5,386,348 A 1/1995 O'Shaughnessey
5,453,902 A 9/1995 Watanabe
5,497,299 A * 3/1996 Wisler et al. ..... 362/343
5,521,798 A 5/1996 Bertling
5,607,219 A * 3/1997 Brummel et al. ..... 362/359
5,671,995 A 9/1997 Serizawa
5,971,575 A * 10/1999 Matubara ..... 362/510
6,036,342 A * 5/2000 Aoki ..... 362/539
6,072,277 A * 6/2000 Yamamoto et al. ..... 362/344
6,132,068 A * 10/2000 Katsumata ..... 362/351

FOREIGN PATENT DOCUMENTS

JP 06251603 * 2/1993 ..... F21M/3/08

* cited by examiner

*Primary Examiner*—Sandra O'Shea
*Assistant Examiner*—Guiyoung Lee
(74) *Attorney, Agent, or Firm*—William E. Meyer

(57) ABSTRACT

A lamp housing assembly as provided which includes a lamp housing and a shield. The shield includes a first portion which extends into the cavity of the lamp housing and a second portion which extends out of the lamp housing. The first portion extends to a blocking end adapted to be positioned adjacent to a lamp disposed within the lamp housing cavity. The second portion includes an attachment end coupled to the lamp housing external of the lamp housing cavity.

25 Claims, 6 Drawing Sheets

LAMP HOUSING ASSEMBLY

TECHNICAL FIELD

The present invention relates to a lamp housing assembly which includes a lamp housing and a shield. The shield extends into the cavity of the lamp housing and is attached to the lamp housing externally of such cavity. The present invention particularly relates to an automotive lamp housing assembly.

BACKGROUND ART

Lamp housing assemblies are well known in the art. One example is the conventional automotive housing assembly. Such an assembly typically includes a lamp housing to which is attached a lens. The lamp housing assembly is structured and arranged to house a lamp therein having connectors attached thereto for electrical and mechanical connection to the wiring system of the vehicle. A reflector is also provided within the lamp housing assembly although in some embodiments the lamp housing may comprise a body which forms the reflector.

In some automotive headlamp housing assemblies heat and light shields are provided. Such a shield extends into the headlamp housing cavity and is attached relative to the housing by mounting a shield support stem to the inside of the reflector. To this end, slots, wedges, screws and the like have been provided inside the reflector to hold the shield stem in place. One of the problems incurred relating to such support structure is that the quality and quantity of light coming from the reflector is reduced. As a practical matter, the structure which supports the shield interferes with the reflected light. In addition, typically, the support stem is press fit into a tapered hole which extends through the reflective surface of the reflector. Such structure effects an undesirable non-optic or "footprint" area of the reflective surface thereby diminishing light output.

This is particularly objectionable when high efficiency reflectors are being used since such reflectors have a smaller than normal amount of reflective surface area available to begin with. Another problem with such support structures is that there is a tendency for the shield to become detached from the lamp housing support surface during use of the lamp.

DISCLOSURE OF THE INVENTION

It is an object of the present invention to provide an improved lamp housing assembly.

It is another object of the present invention to obviate the disadvantages of the prior art by providing an improved lamp housing assembly.

Another object of the present invention is to provide an improved lamp housing assembly wherein the lamp shield support effects a relatively small footprint upon the reflective surface of the lamp reflector.

Still another object of the present invention is to provide an improved lamp housing assembly wherein the quality and quantity of the light coming from the reflector is not substantially reduced by the presence of the shield support.

Yet another object of the present invention is to provide an improved lamp housing assembly wherein the tendency for the shield stem to become detached from the lamp housing support surface is substantially reduced if not eliminated.

Another object of the present invention is to provide an improved lamp housing which may be readily fabricated by molding.

Still another objective of the present invention is to provide an improved lamp housing which includes a lamp housing which may be readily fabricated by conventional molding procedures.

A further object of the present invention is to provide an improved automotive lamp housing assembly which achieves all of the foregoing objectives.

This invention achieves these and other objects by providing a lamp housing assembly which comprises a lamp housing. The lamp housing comprises an inner surface and an outer surface. A through passage extends from the inner surface to the outer surface. A shield extends through the through passage. The shield comprises a first portion, a second portion and a blocking end. The first portion extends into the lamp housing to the blocking end, and the second portion extends out of the lamp housing and is coupled to the second surface.

BRIEF DESCRIPTION OF THE DRAWINGS

This invention may be clearly understood by reference to the attached drawings in which like reference numerals designate like parts and in which.

MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
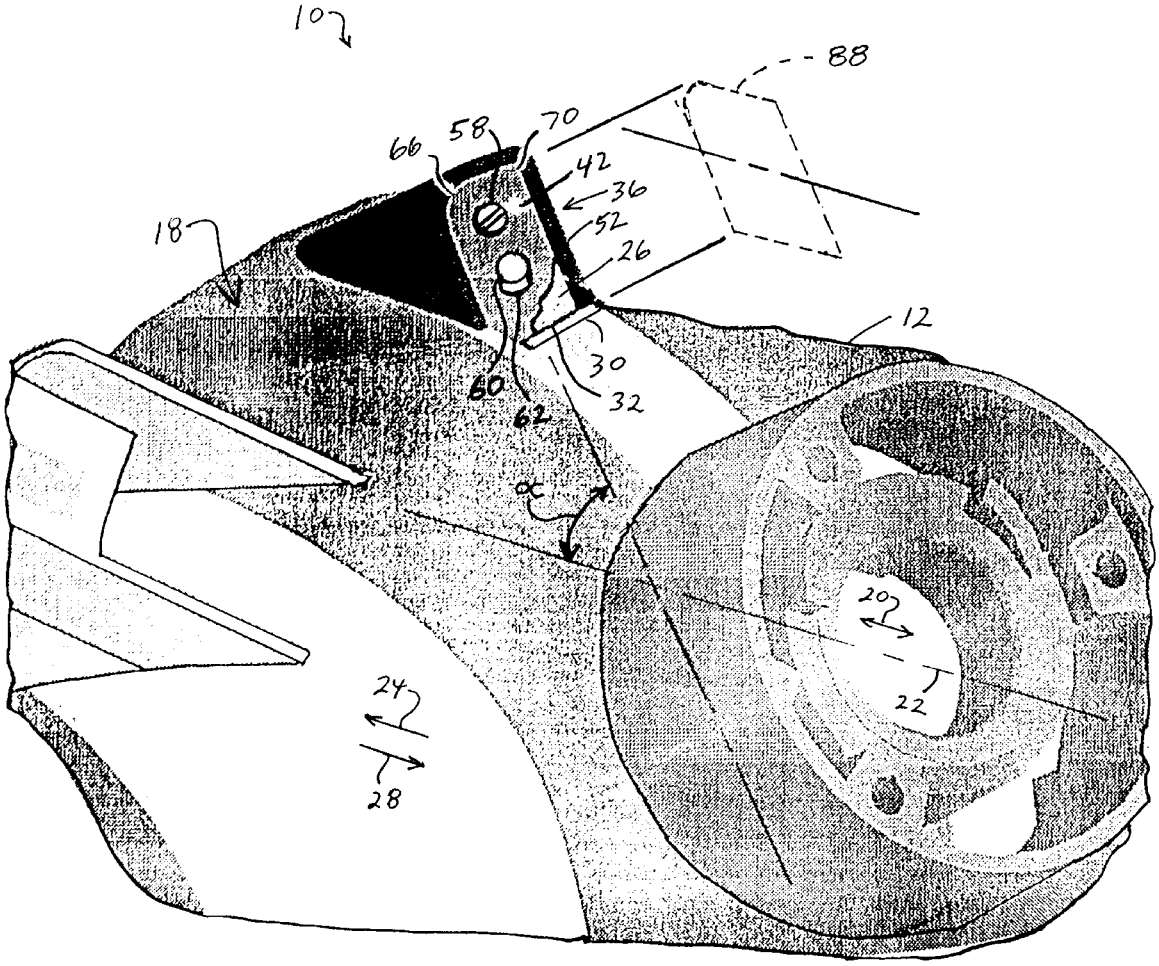
FIG. 1 is a perspective view of a rear portion of one embodiment of the lamp housing assembly of the present invention.
Figure 2:
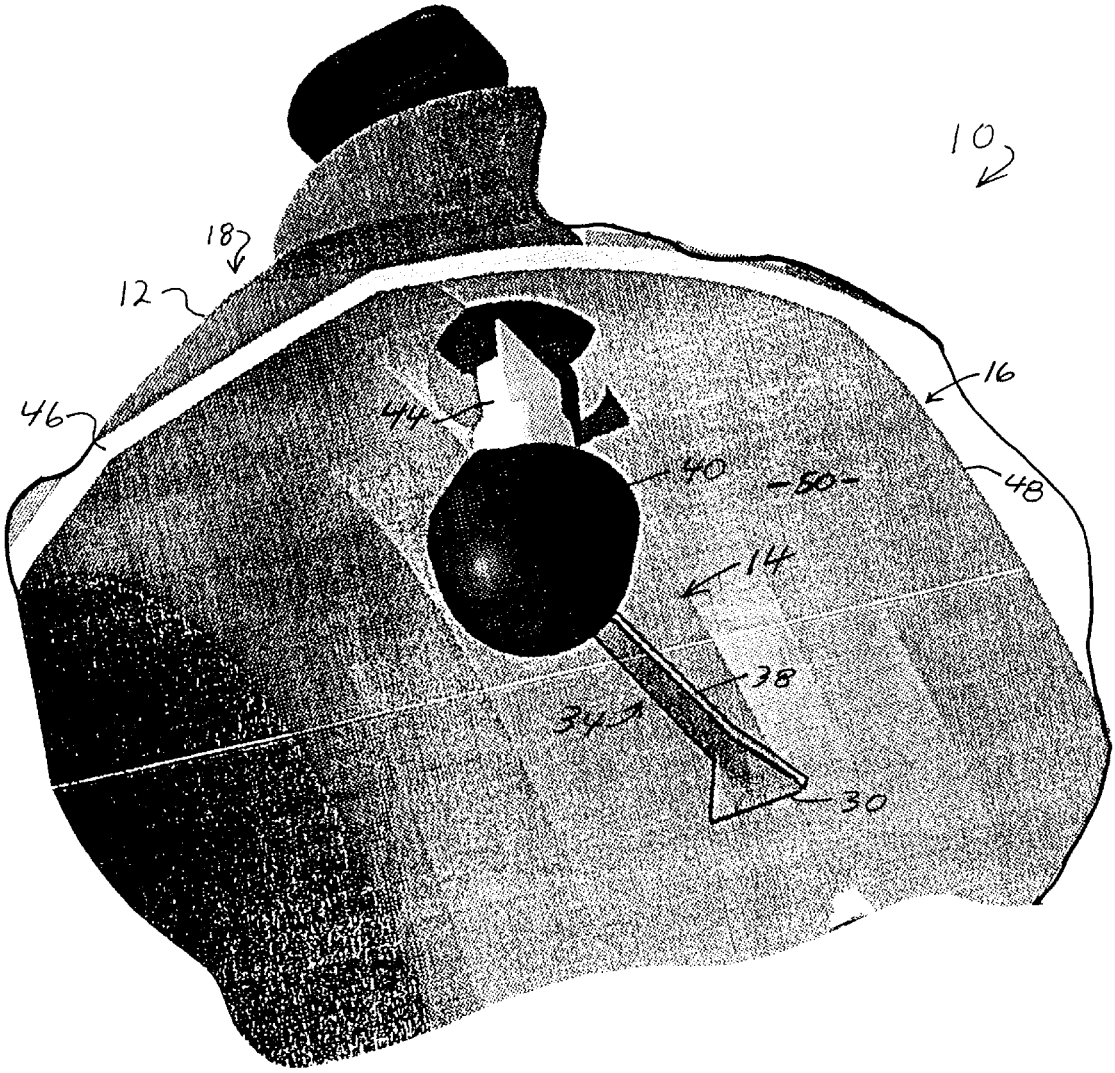
FIG. 2 is a perspective view of a front portion of the lamp housing assembly of FIG. 1.

The embodiment of this invention which is illustrated in the drawings is particularly suited for achieving the objects of this invention. FIGS. 1 and 2 illustrate a lamp housing assembly 10 which comprises a lamp housing 12 and a shield 14. The lamp housing 12 comprises an inner surface 16 which defines a housing cavity and an outer surface 18. Lamp housing 12 extends in the direction 20 of an axis 22. The inner surface 16 faces axially in a forward direction 24. The outer surface 18 comprises a raised portion which includes a mounting face 26 which faces axially in an opposite rearward direction 28. In the embodiment illustrated in FIG. 1, the mounting face 26 is planar. A through passage 30 extends from the inner surface 16 to the outer surface 18. The through passage 30 is in the form of a slit positioned adjacent an edge 32 of the mounting face 26. The through passage 30 is perpendicular to the axis 22 as illustrated at $\alpha$.

The shield 14 includes a first portion, a second portion and a blocking end, and extends through the through passage 30. In particular, a first portion 34 of the shield 14 extends into the lamp housing 12, and a second portion 36 extends out of the lamp housing. In the embodiment illustrated in FIGS. 1 to 3, the first portion comprises a stem 38 which extends from a blocking end 40 to an opposite attachment end 42 which forms the second portion 36. The blocking end 40 faces the inner surface 16 to shield a lamp 44. To this end, the blocking end 40 includes a bowl shaped cavity into which the lamp 44 extends in a conventional manner. The attachment end 42 extends through the through passage 30. The attachment end 42 is adjacent the mounting face 26 and is coupled to the outer surface 18 as described hereinafter.

The lamp housing assembly includes a reflector disposed within the lamp housing between the blocking end 40 and the inner surface 16, such reflector having a reflective surface facing the blocking end. Without limitation, this is accomplished in the embodiment illustrated in FIGS. 1 and 2 by providing the lamp housing in the form of a body 46 which forms a reflector 48 having a reflective surface 50. The reflector 48 is coextensive with the inner surface 16. The through passage 30 extends completely through the body 46 and reflector 48. Due to the slit-like configuration of the through passage 30, there is only a minimal loss of reflective surface caused by the through passage. The lamp housing assembly will typically be enclosed by a lens (not shown) in a conventional manner. If it is necessary for the lamp housing assembly to be sealed, a sealant may be placed within the through passage 30.

The mounting face and the attachment end of the present invention may each comprise a peripheral wall, the peripheral wall of the attachment end conforming to at least a portion of the peripheral wall of the mounting face in such a manner that the attachment end mates with the mounting face. For example, in the embodiment illustrated in FIG. 1, the mounting face 26 of lamp housing 12 comprises a peripheral wall 52. The edge of the attachment end 42 provides a peripheral wall 54 which conforms to the wall 52. The peripheral walls 52 and 54 are semicircular in configuration.

In order to couple the shield 14 to the lamp housing 12, the attachment end 42 of the shield comprises a hole 56 which extends therethrough. A mounting attachment such as a screw 58 extends through the hole 56 and is threaded into the outer surface 18 at the mounting face 26 to couple the attachment end 42 to the mounting face. In this manner, the shield 14 is attached to the back side of the lamp housing rather than at the reflective surface of the reflector. In order to assure that the stem 38 does not rotate relative to the lamp housing 12 when the screw 58 is turned, the mounting face and the attachment end may each comprise a key element which mates with each other. For example, in the embodiment illustrated in FIG. 1, the mounting face 26 comprises a key element in the form of a cylindrical protuberance 60 and the attachment end 42 comprises a mating cylindrical aperture 62. When the lamp housing assembly is assembled as described hereinafter, the protuberance 60 extends into and mates with the aperture 62 thereby preventing rotation of the shield 14 as the screw 58 is tightened. As a practical matter, the shield is held from rotating at two points which include the point where the screw 58 engages the mounting face 26 and the point where the protuberance 60 mates with the aperture 62.

Figure 4:
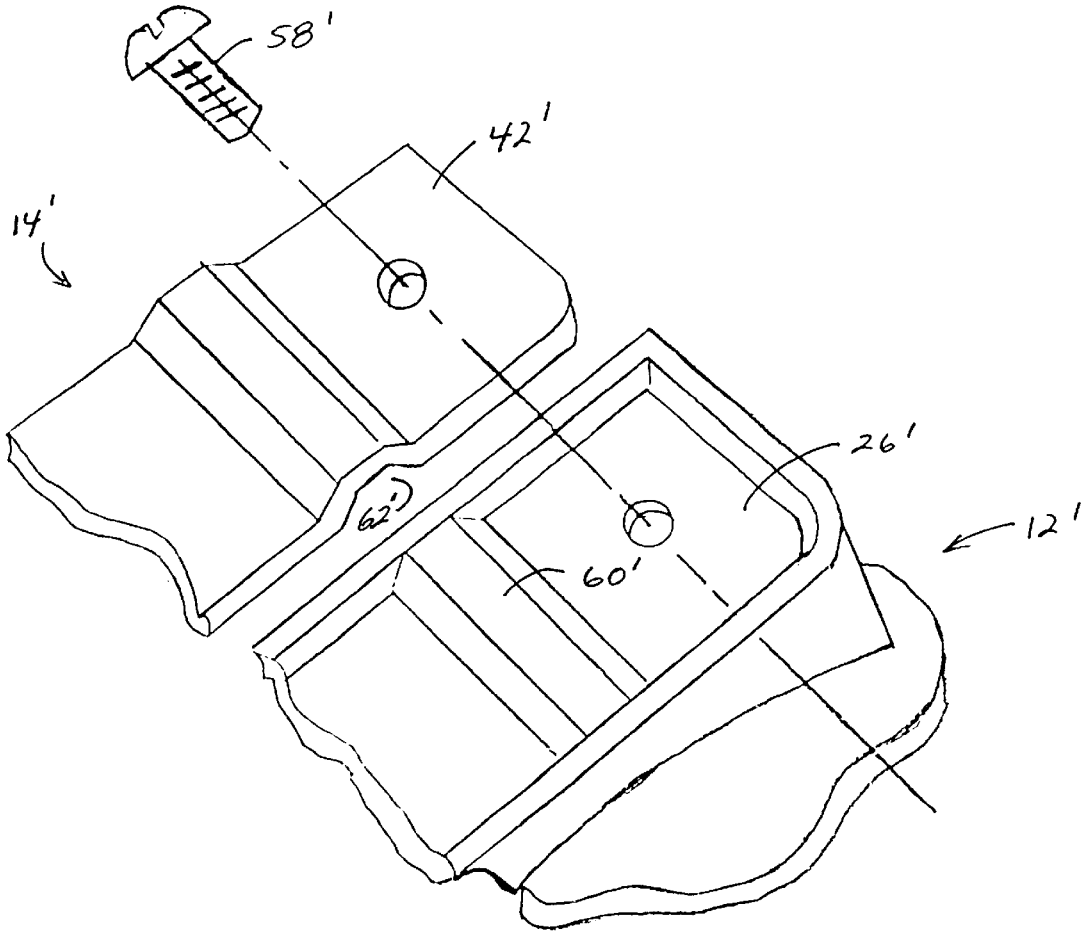
FIG. 4 is a perspective exploded view of a portion of another embodiment of the lamp housing assembly of the present invention.

Other types of mating key elements may be provided. For example, the mounting face 26 and/or the attachment end 42 may comprise one or more bump, wrinkle, edge or any other structural configuration which prevents rotation of the shield relative to the mounting face as a result of engagement of the attachment end with the mounting face. For example, in the embodiment illustrated in FIG. 4, the lamp housing 12' and the shield 14' are identical to lamp housing 12 and shield 14 with the exception that different types of mating key elements are provided. In particular, the mounting face 26' of the lamp housing 12' comprises a transversely extending elongated protuberance 60' which replaces the cylindrical protuberance 60. Similarly, the attachment end 42' comprises a mating elongated channel 62' which replaces the aperture 62. When the lamp housing assembly is assembled as described hereinafter, the protuberance 60' extends into and mates with the aperture 62' thereby preventing rotation of the shield 14' as the screw 58' is tightened.

Figure 3:
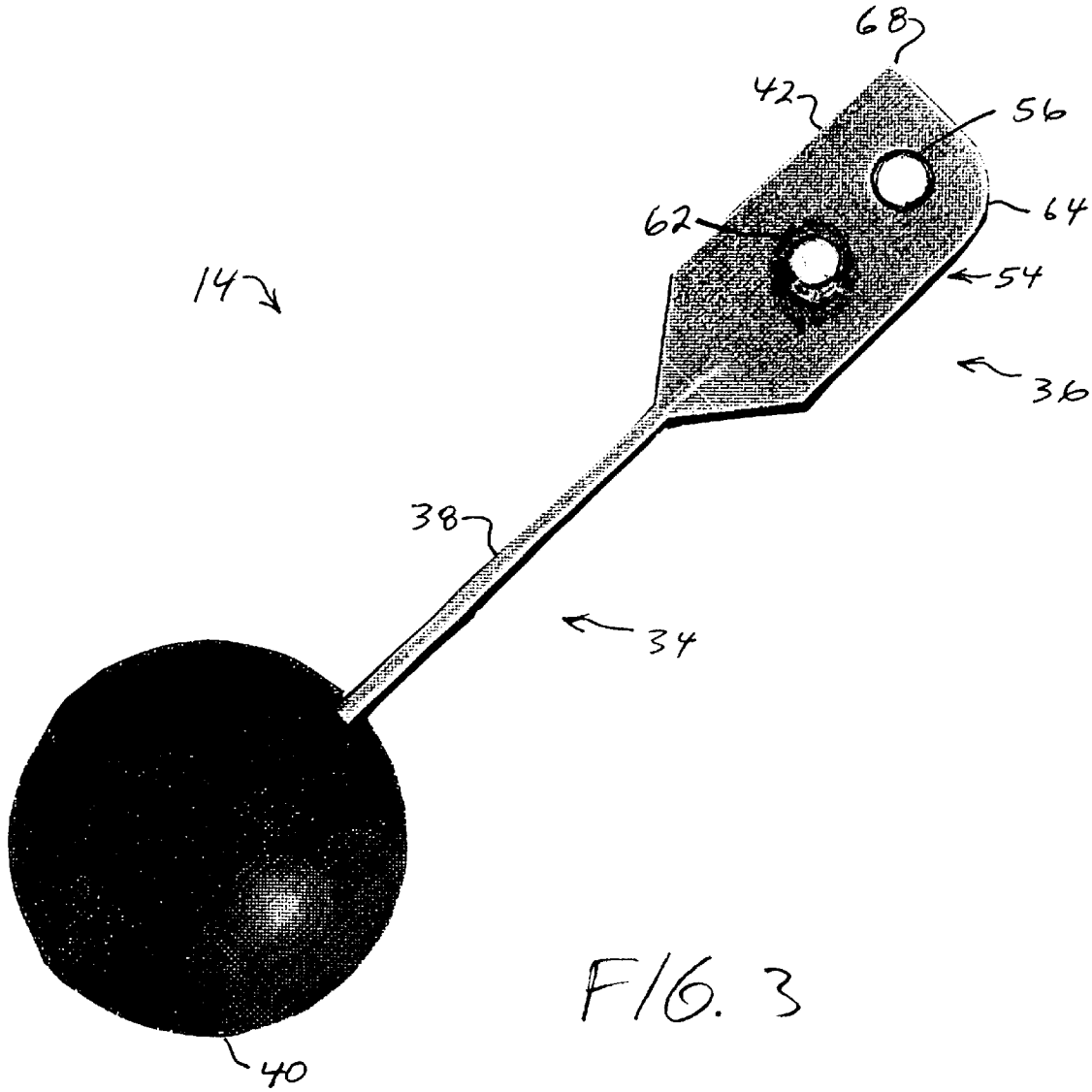
FIG. 3 is a view of the embodiment of the shield of the present invention illustrated in FIG. 1.
Figure 5:
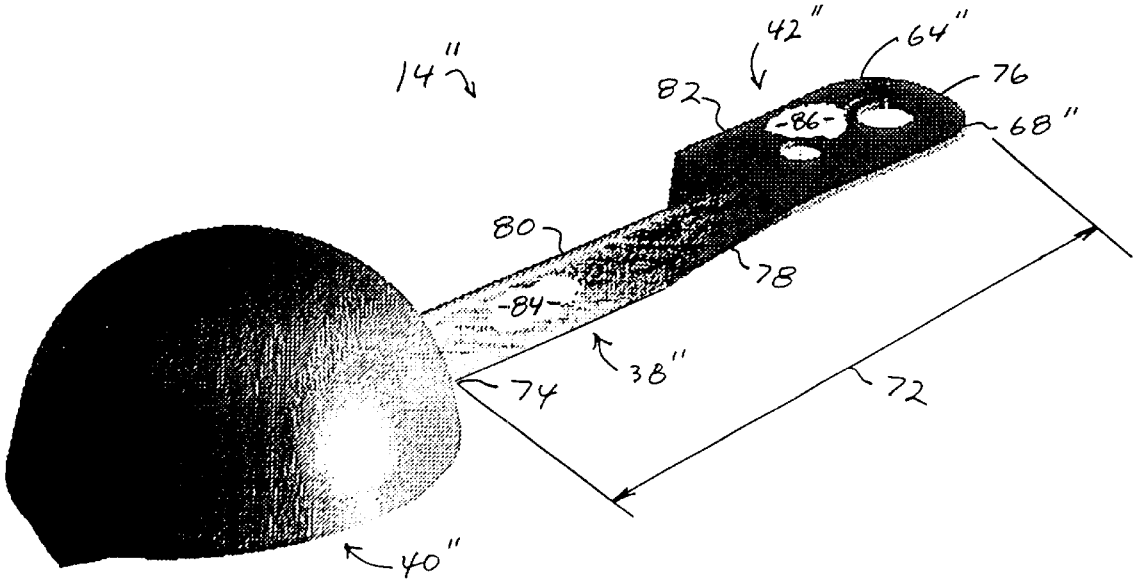
FIG. 5 is a perspective view of one alternative embodiment of the shield of the present invention.

If desired, the attachment end of the shield of the present invention may be structured and arranged to mate with the mounting face of the lamp housing in a predetermined orientation. For example, it may be desirable to couple one shield to a right hand lamp, provided with a right hand reflector, in one orientation and another shield to a left hand lamp, provided with a left hand reflector, in another orientation. To this end, in the embodiment illustrated in FIGS. 1 and 3, the corners 64 and 66 of the attachment end 42 and mounting face 26, respectively, are rounded, whereas respective corners 68 and 70 are square. By structuring and arranging the lamp housing 12 and shield 14 in this manner, there is only one predetermined manner in which the shield and lamp housing may be mated together. In particular, the embodiment illustrated in FIGS. 1 and 3 is keyed for a right hand application. If a left hand application is desired, the corners 64 and 66 would be square, and the corners 68 and 70 would be rounded. If it is desired to provide a shield which may be mated with a lamp housing whether the housing embodies a right hand or left hand application, a shield and lamp housing may be provided wherein respective corners 64, 66 and 68, 70 are all rounded. For example, FIG. 5 illustrates a shield 14" having a stem 38", a blocking end 40" and an attachment end 42". In this embodiment, the corners 64", 68" of the attachment end 42" are equally rounded. Similarly, a mounting face of a lamp housing may be provided which comprises equally rounded corners for mate with corners 64", and 68". By providing a right hand lamp housing 12" and a left hand lamp housing 12" with such structure, the shield 14" may be used with either lamp housing.

The stem and the attachment end of the shield of the present invention may be formed from a single sheet of metal, if desired. For example, in the embodiments illustrated in FIGS. 3 and 5, the stem and attachment end are formed from a single length of metal. For example, in the embodiment illustrated in FIG. 5, the single length of metal 72 is folded between opposite ends 74 and 76 at a folding juncture 78 to form a stem segment 80 and an attachment end segment 82 joined together at the the shield 14 in place. When assembled in this manner, the shield 14 will have been keyed by respective mating corners 64 and 66 so that the blocking end 40 will be properly oriented adjacent the lamp 44. Further, the mating of the key elements 60 and 62 prevent rotation of the shield 14 as the screw 58 is threaded into the lamp housing 12.

Figure 6:
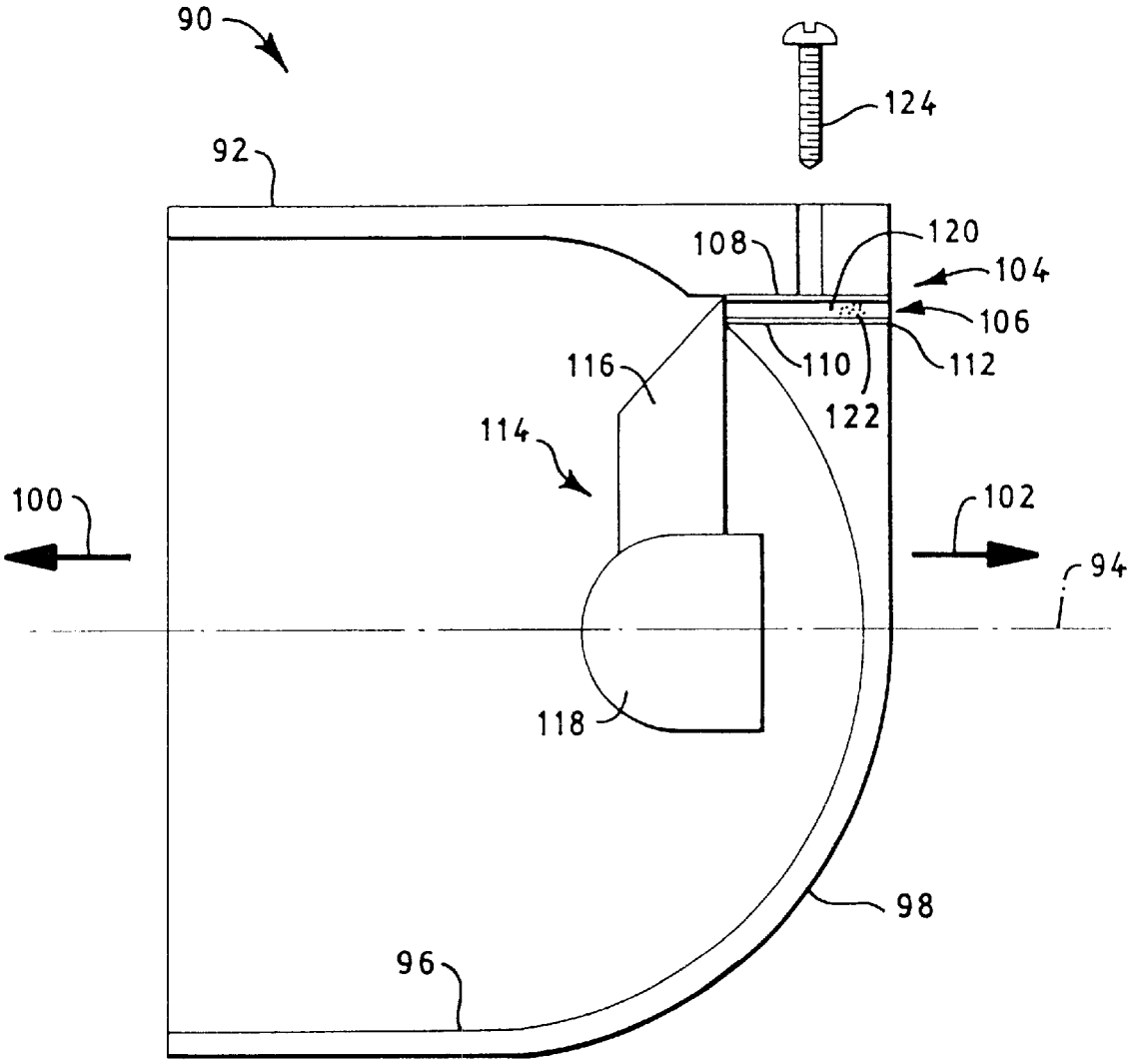
FIG. 6 is an elevational diagrammatic representation of another alternative embodiment of the lamp housing assembly of the present invention.

FIG. 6 illustrates an alternative embodiment of the lamp housing assembly of the present invention. FIG. 6 illustrates a lamp housing assembly 90 which comprises a lamp housing 92 in the form of a shell having an axis 94. The shell-like lamp housing 92 comprises a first surface 96 and a second surface 98, the first surface being concave, reflective and facing axially in a forward direction 100. The second surface 98 faces in an opposite rearward direction 102. A mounting face 104 is formed on the second surface 98. A through passage 106 extends from the first surface 96 to the second surface 98. Through passage 106 is in the form of a slot having opposing slot walls 108, 110. The opening 112 of the slot 106 is adjacent the mounting face 104. A shield 114 is also provided. Shield 114 comprises a stem 116 which extends from a blocking end 118 to an attachment end 120. Blocking end 118 faces the surface 96, and the attachment end 120 extends through the through passage 106 and is disposed adjacent walls 108, 110. The attachment end 120 is coupled relative to the slot walls 108, 110. For example, glue 122 may be disposed within the through passage 106 to adhere the attachment end 120 thereto. In an alternative embodiment, a screw 124 (illustrated in phantom lines in FIG. 6) which extends transverse to the slot walls 108, 110 may be threaded into engagement with the attachment end 120, For example, screw 124 could be threaded through the attachment end 120 to hold it in place.

As is the case regarding the embodiment illustrated in FIGS. 1 and 2, the shield 114 will not be attached to the reflective surface of a reflector positioned within the lamp housing and the opening 112 of the narrow slot 106 will effect an inconsequential footprint upon such reflective surface. It will be noted that whereas the through passage 30 and attachment end 42 are perpendicular to the axis 22 of the lamp housing 12, the attachment end 120 and through passage 106 are parallel to the axis 94 of the lamp housing 92. The attachment end and through passage of the present invention may be oriented in some other angular direction relative to the lamp housing axis provided the attachment end can be inserted through the through passage and the blocking end can be structured and arranged to be disposed relative to the lamp as required.

In considering the lamp housing assembly of the present invention, the narrow slit or slot-like through opening 30, 106 provides a relatively small footprint upon the reflective surface of the reflector. In addition, with the exception of the stem 38, 116 no shield mounting hardware is disposed within the cavity of the lamp housing 12. Accordingly, the quality and the quantity of the light coming from the reflector is not impeded by the attachment end 42, 120 or the screw 58, 124. This is a significant improvement over previous designs wherein the shield mounting structure is relatively large, and a not inconsequential portion of the reflector never "sees" the lamp filament. This improvement is particularly significant regarding conventional high efficiency reflectors which when viewed from the front are typically small and very deep. In order to provide a good beam pattern in such reflectors, as much reflective surface area as possible is required. The lamp housing assembly of the present invention accomplishes this objective.

The lamp housing of the present invention may be readily fabricated from a plastic material by conventional molding procedures. For example, it is easier to mold features that are perpendicular to the mold faces. Molding the through passage perpendicular to the axis of the lamp housing, and molding the mounting face transverse or parallel to such axis, meets this condition. As such, in the lamp housing of the present invention, the through passage and the mounting block and mounting face can be molded without the need for additional slides or lifters or similar moving inserts and the like during the molding process.

The shield of the present invention may be readily fabricated from a metal material by conventional stamping, bending, folding, punching, flaring, and the like, as required to orient the shield as desired.

The embodiments which have been described herein are but some of several which utilize this invention and are set forth here by way of illustration but not of limitation. It is apparent that many other embodiments which will be readily apparent to those skilled in the art may be made without departing materially from the spirit and scope of this invention.

We claim:

1. A lamp housing assembly, comprising:

a molded lamp housing for enclosing a lamp, the lamp housing having an inner surface to face generally a light source, the inner surface arranged around an axis, the lamp housing having a first opening arranged around the axis permitting passage of light through the first opening generally in an axial direction, the lamp housing having an outer surface, with a mounting face as a segment thereof extending perpendicular to the axis, wherein a second opening, comprising a through passage extends from the inner surface to the outer surface, in a direction perpendicular to the axis with the mounting face adjacent an exterior end of the through passage, and the housing assembly including a shield extending through the through passage, the shield comprising a first portion extending into said lamp housing, a second portion extending out of said lamp housing and being coupled to the mounting face, and a blocking end extending from said first portion.

2. The lamp housing assembly of claim 1 wherein said outer surface comprises a mounting face, and further wherein said first portion comprises a stem and said second portion comprises an attachment end, said stem extending from said blocking end to said attachment end, said blocking end facing said inner surface, said stem extending into said lamp housing at said through passage, and said attachment end extending out of said lamp housing and being adjacent said mounting face, said attachment end being coupled to said mounting face.

3. The lamp housing assembly of claim 2 wherein said mounting face comprises a first peripheral wall, and said attachment end comprises a second peripheral wall conforming to at least a portion of said first peripheral wall.

4. The lamp housing assembly of claim 2 wherein said mounting face comprises a first key element and said attachment end comprises a mating second key element.

5. The lamp housing assembly of claim 4 wherein (a) said first key element comprises one of an aperture extending from said outer surface to said inner surface and a protuberance extending from said mounting face, and (b) said second key element comprises a mating one of a protuberance extending from, and an aperture extending through, said attachment end.

6. The lamp housing assembly of claim 4 wherein said mounting face comprises a first peripheral wall, and said attachment end comprises a second peripheral wall conforming to at least a portion of said first peripheral wall.

7. The lamp housing assembly of claim 6 wherein (a) said first key element comprises one of an aperture extending from said outer surface to said inner surface and a protuberance extending from said mounting face, and (b) said second key element comprises a mating one of a protuberance extending from, and an aperture extending through, said attachment end.

8. The lamp housing assembly of claim 1 further including a reflector disposed within said lamp housing between said blocking end and said inner surface, said reflector comprising a reflective surface facing said blocking end, said through passage extending through said reflector.

9. The lamp housing assembly of claim 8 wherein said reflector is coextensive with said inner surface.

10. The lamp housing assembly of claim 1 wherein said cuter surface is structural and arranged to mate with said second portion in a predetermined orientation.

11. The lamp housing assembly of claim 1, wherein said second portion comprises a hole extending therethrough, and further wherein a mounting attachment extends through said hole and couples said second portion to said mounting face.

12. The lamp housing assembly of claim 1, wherein said first portion and said second portion are formed from a single sheet of metal, said sheet being folded between opposite ends at a folding juncture to form a first stem segment and a second stem segment joined together at said folding juncture.

13. The lamp housing assembly of claim 12 wherein said first stem segment extends in a first plane and said second stem segment extends in a second plane, said second plane being oriented at 90° relative to said first plane.

14. The lamp housing assembly of claim 13 wherein said mounting face extends transverse to said axis.

15. The lamp housing assembly of claim 13 wherein said mounting face extends parallel to said axis.

16. A lamp housing assembly, comprising:

a molded lamp housing having an axis and comprising an inner surface facing axially in a forward direction and an outer surface, said outer surface comprising a mounting face facing axially in an opposite rearward direction, a through passage extending perpendicular to the axis and from said inner surface to said outer surface adjacent an edge of said mounting face;

a shield extending through said through passage and comprising a first portion, an opposite second portion, and a blocking end, said first portion extending into said lamp housing to said blocking end, and said second portion extending out of said lamp housing and being coupled to said outer surface, said blocking end facing said inner surface; and a reflector disposed within said lamp housing between said first portion and said inner surface, said reflector comprising a reflective surface facing said first portion, said through passage extending through said reflector.

17. The lamp housing assembly of claim 16 wherein said second portion comprises an attachment end which mates with and is attached to said mating face.

18. The lamp housing assembly of claim 17 wherein said mounting face comprises a first key element and said attachment end comprises a mating second key element.

19. The lamp housing assembly of claim 18 wherein (a) said first key element comprises one of an aperture extending from said outer surface to said inner surface and a protuberance extending from said mounting face, and (b) said second key element comprises a mating one of a protuberance extending from, and an aperture extending through, said attachment end.

20. The lamp housing assembly of claim 19 wherein said attachment end comprise a hole extending therethrough, and further wherein a mounting attachment extends through said hole and couples said attachment end to said mounting face.

21. A lamp housing assembly comprising:

a shell having an axis, a first surface and a second surface, the first surface being concave, reflective and facing axially in a forward direction, the second surface facing in an opposite rearward direction, a mounting surface formed on the second surface, a through passage extending from the first surface to the second surface, said through passage comprising a slot, said opening of the slot being adjacent the mounting face; and a shield having a blocking end, a stem and an attachment end, the blocking end facing the first surface, the attachment end extending through the slot passage and being adjacent the walls forming the slot, and the attachment end being coupled to the slot walls.

22. The lamp housing assembly of claim 21, wherein a glue fills the region intermediate the attachment end and the walls forming the slot.

23. The lamp housing assembly in claim 21, wherein a screw extends transverse to the slot walls and engages the attachment end.

24. A lamp housing assembly, comprising:

a molded lamp housing for enclosing a lamp, the lamp housing having an inner surface to face generally a light source, the inner surface arranged around an axis with an axial direction, the lamp housing having a first opening arranged around the axis permitting passage of light through the first opening generally in the axial direction, the lamp housing having an outer surface, with a mounting face as a segment thereof, extending perpendicular to the axis, wherein a second opening, molded in the lamp housing, comprising a through passage extending from the inner surface to the outer surface, and adjacent an exterior end of the through passage is the mounting face, and the housing assembly including a shield extending through the through passage, the shield comprising a first portion extending into said lamp housing, a second portion extending out of said lamp housing and being coupled to the mounting face, and a blocking end extending from said first portion.

25. The lamp housing assembly in claim 24, wherein the mounting face and the second portion of the shield each include respective keying features to orient the shield with respect to the mounting face in a fixed relation.

* * * * *